United States Patent [19]

Varga

[11] 4,128,917

[45] Dec. 12, 1978

[54] CARDING ENGINES

[75] Inventor: John M. J. Varga, Halifax, England

[73] Assignee: Carding Specialists (Canada) Limited, Toronto, Canada

[21] Appl. No.: 792,145

[22] Filed: Apr. 29, 1977

[30] Foreign Application Priority Data

May 3, 1976 [GB] United Kingdom ..... 17946/76

[51] Int. Cl.[2] ..... D01G 15/40

[52] U.S. Cl. ..... 19/105; 19/98; 19/106 R

[58] Field of Search ..... 19/105, 106 R, 98, 99, 19/156.3, 156.4

[56] References Cited

U.S. PATENT DOCUMENTS

| | | | |
|---|---|---|---|
| 1,461,562 | 7/1923 | Rooney | 19/105 |
| 3,144,686 | 8/1964 | Aoki | 19/105 |
| 3,249,967 | 5/1966 | Varga | 19/106 R |
| 3,373,461 | 3/1968 | Bessette et al. | 19/105 X |

FOREIGN PATENT DOCUMENTS

| | | | |
|---|---|---|---|
| 1375275 | 9/1964 | France | 19/98 |
| 1189372 | 4/1970 | United Kingdom | 19/98 |

*Primary Examiner*—Dorsey Newton

*Attorney, Agent, or Firm*—Bierman & Bierman

[57] ABSTRACT

In a duo-card engine, a novel arrangement of crush rolls and toothed roller are used to break up the fibre web into individual fibres and fibre groups to free them from dirt, after which the fibres are reassembled on the surface of a perforated vacuum cage adjacent to and downstream of the toothed roller. This sequence of operations produces a yarn, not only of more regular texture but yarn in which the amount of trash, dust and small fibres can be reduced substantially by one half.

7 Claims, 5 Drawing Figures

CARDING ENGINES

Figure 1:
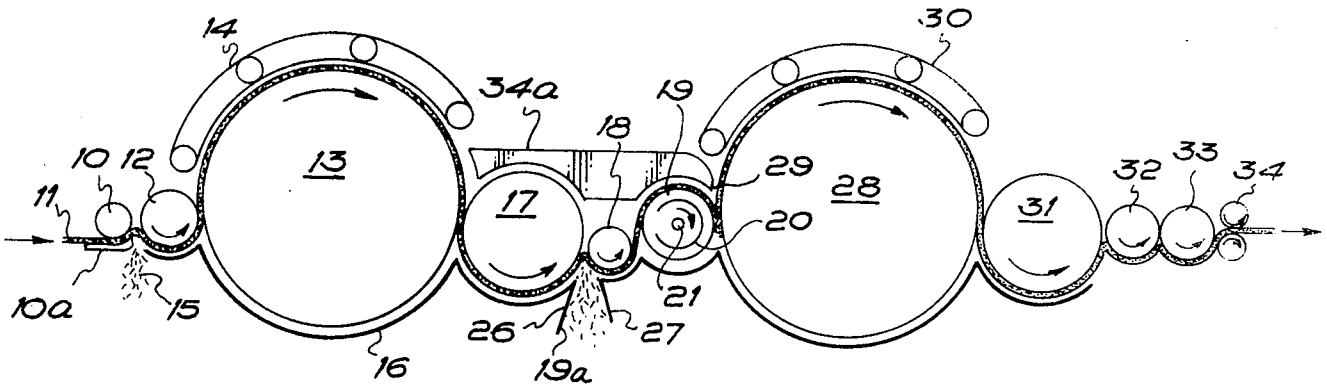

This invention relates to carding engines. The invention is particularly concerned with the so called duo-card, which comprises two carding engines, a first or breaker card and a second or finisher card, interconnected by suitable rollers for transferring a web from the breaker card to the finisher card. Duo-cards are known per se and they can achieve a much higher degree of cleaning of the fibres than is possible with a conventional single card. This occurs because the web removed from the breaker card is passed in full width to the finisher card and the fact that the finisher card receives a fine carded web increases the opportunity of the wires of the finisher card to separate remaining fibre agglomerations and so liberate impuritites from the web. The cleaning action in a duo-card is improved if the web is subjected, during its passage between the breaker card and the finisher card, to the action of a pair of pressure rollers which can crush impurities in the web and allow these either to fall from the web or be removed by the finisher card.

The technique of open-end spinning is now becoming increasingly important and it is essential to efficient operation of that method that the fibres fed to the rotor of the open-end spinning machine be as clean as possible. Accordingly the demand for silver that is even cleaner than that produced by the conventional duo-card is now important in order that open-end spinning methods may be rendered more efficient.

According to the present invention an arrangement for carding staple fibres in a duo-card carding engine comprises feeding the fibres to the cylinder of a breaker card, doffing the web of fibres from the breaker cylinder, feeding the web from the doffer to a toothed roller rotating at a surface speed sufficient to break up the web substantially into individual fibres or fibre groups and free dirt from the fibres, reassembling the fibres on the surface of a partly shrouded, rotating, perforated vacuum cage, feeding the fibres from the cage to the cylinder of a finisher card, and doffing the web of fibres from the finisher cylinder.

From another aspect, a duo-card carding engine according to the invention comprises a breaker card having a breaker carding cylinder, means for feeding staple fibres to the breaker cylinder, a breaker doffer for doffing the web of fibres from the breaker cylinder, a toothed roller to which the doffed web passes, means for rotating the toothed roller at a surface speed sufficient to break up the web substantially into individual fibres or fibre groups and free dirt from the fibres, a partly shrouded, rotatable, perforated vacuum cage on the surface of which the fibres are reassembled, means for feeding the fibres from the cage to the cylinder of a finisher card, and a finisher doffer for doffing the web from the finisher cylinder.

The invention resides in breaking up the web between the breaker cylinder and the finisher cylinder due to the action of the faster rotating toothed roller, so dividing the web substantially into individual fibres or fibre groups and setting free impurities and dust from the web received from the breaker card. Trash, dirt and some short fibre will fall from the web during this action and can be extracted from the card. The longer, usable fibres together with dust and some short fibres will be carried to the cage surface and the vacuum will extract much of the dust and short fibres, and will assemble the larger fibres into a web on the cage surface. By carrying out this operation a very remarkable improvement in the cleanliness of the fibres fed to the finisher cylinder is achieved and consequently the final carded web will be cleaner than it otherwise would have been. This can make a significant difference in productivity of open-end spinning units to which sliver from this web is fed, and can also materially improve the quality of the finished spun yarn.

Preferably the surface speed of the toothed roller is from 2 to 6 times that of the roller preceding it, with a preferred range of from 2.5 to 4. If the speed ratio is much less than two the web may merely be drafted and not broken up; if the ratio is more than six then damage to individual fibres may result. The higher ratios in the preferred range will generally be used when processing coarser, shorter staple fibres, lower ratios being used for finer and longer staple fibres which are more liable to damage.

The vacuum cage may itself act as a takerin for the finisher cylinder, but preferably a separate finisher takerin is provided for transferring the web from the cage to the finisher cylinder. The finisher takerin may take the web direct from the cage surface, or one or more transfer rollers may be provided between the cage and the finisher takerin.

The toothed roller may take the web directly from the breaker doffer, or there may be intermediate rollers between the breaker doffer and the toothed roller. Any intermediate roller immediately preceding the toothed roller may be either toothed or plain, and if plain may form one of a pair of crush rolls. If the intermediate roller immediately preceding the toothed roller is also toothed the web may be contacted by the lower arcs of the two toothed rollers and between the two rollers may pass over a guide member extending the full width of the rollers below the closest approach point of the rollers. The guide member is conveniently set in the space between the lower converging arcs of the two toothed rollers so that it extends parallel with the axes of both rollers and is spaced closely adjacent to the peripheral surfaces of each roller. Thus, the web taken from the first toothed roller passes over the guide member and sharply changes direction before being torn substantially into individual fibres by the faster, second toothed roller, the guide member acting as an anvil for this tearing process. The guide member preferably has a rounded surface over which the web travels so that fibre damage is reduced, and the rounded surface is preferably smooth and plain, but could be fluted, grooved or otherwise patterned over part or all of its length. The guide member may form part of a shroud over part of the lower arc of the first toothed roller.

Using first and second toothed rollers, whether or not a guide member is present it is preferable to pass the web through a pair of crush rolls during its passage from the breaker card to the first toothed roller. One or more transfer rollers may be provided between the breaker doffer and the crush rolls and/or between the crush rolls and the first toothed roller. Such crush rolls exert substantial heavy pressure on the web in order that impuritites in the web after the first carding action may be crushed. This crushing action facilitates the trash removal by the first and second rollers.

In a particularly preferred arrangement the web is taken from a first card-clothed roller by a second card-clothed roller rotating at a peripheral speed at least twice that of the first card-clothed roller so that the web is broken down substantially into individual fibres or fibre groups, a guide member is set in the space between the bottom converging arcs of the first and second rollers so that the web undergoes a sharp change in direction before being broken down by the second roller, the fibres are condensed back into a web on the outer surface of a partly shrouded rotatable perforated vacuum cage and fed from there by way of a takerin to the cylinder of the finisher card. This process effects a thorough breaking up of the web to give a high percentage removal of the trash and dust remaining in the web. The air stream which is caused to flow in the vicinity of the second roller assists to cause separation of usable fibre and trash, and transfers any usable fibre not carried by the second roller on to the surface of the vacuum cage.

Embodiments of carding engines according to the invention will now be described in more detail, by way of example only, with reference to the accompanying drawings in which:

FIG. 1 is a schematic side elevation of a first embodiment of carding engine; and FIGS. 2 to 5 are each an enlarged view of a centre section of a further embodiment of carding engine.

As is shown in FIG. 1 a lap 11 of fibres to be carded is fed into the carding engine by a feed roller 10 over a feed table 10*a*. From the feed roller 10 the web is passed by a takerin 12 on to the surface of the cylinder 13 of the first or breaker card. The web receives an initial cleaning between the feed roller 10 and takerin 12 and some of the trash 15 from the web falls from the takerin roller at the position of the usual mote knives (not shown). The web on the cylinder 13 is subjected to carding between the wire clothing on the flats 14 working in conjunction with the cylinder. Small particles of trash are retained by the wires on the flats, which are subsequently cleaned before these wires again move adjacent to the surface of the cylinder, and trash can also fall through an underscreen 16 located below the cylinder 13. The carded web is removed from the breaker cylinder 13 by a doffer 17. The web is stripped from the doffer 17 by a toothed roller 18 rotating at a surface speed sufficiently higher than the doffer for the web to be broken down into individual fibres or fibre groups. By this action trash and dirt are set free to fall into a chute 19*a* between baffles 26 and 27. Longer, usable fibres carried by or thrown from the surface of roller 18 are collected on the surface of a vacuum cage 19 rotating at a peripheral speed less than roller 18, and sufficiently low to collect enough fibres per unit area to form a web. The cage 19 has a perforated surface which is partially shrouded by a shroud 20, and air is sucked from the cage through an axial pipe 21. The vacuum in cage 19 not only causes the fibres thrown from roller 18 to be collected on the surface of the cage, but it also sucks residual dust into the interior of the cage and thence through the pipe 21 to a waste outlet, so leaving the fibre even cleaner.

The cage 19 also acts as a feeder for the cylinder 28 of the second or finisher card, a baffle plate 29 being positioned to control the size of the cooperating area between the cage and the finisher cylinder. Cage 19, operating at a slower speed than the preceding roller, randomly distributes the fibres over a large area, and causes no variation in sliver content. After further carding between this cylinder and the flats 30 with which the cylinder cooperates, the finally carded web is removed from cylinder 28 by a doffer 31 and from the doffer the web passes over a stripper roller 32, a re-directing roller 33 and a pair of crush rollers 34 before passing to a sliver forming trumpet, calendar rolls and a coiler, the last three elements not being shown. The re-directing roller 33 could be omitted if desired. A dust extracting hood 34*a* is located above the rollers between the doffer 17 and finisher cylinder 28.

Figure 2:
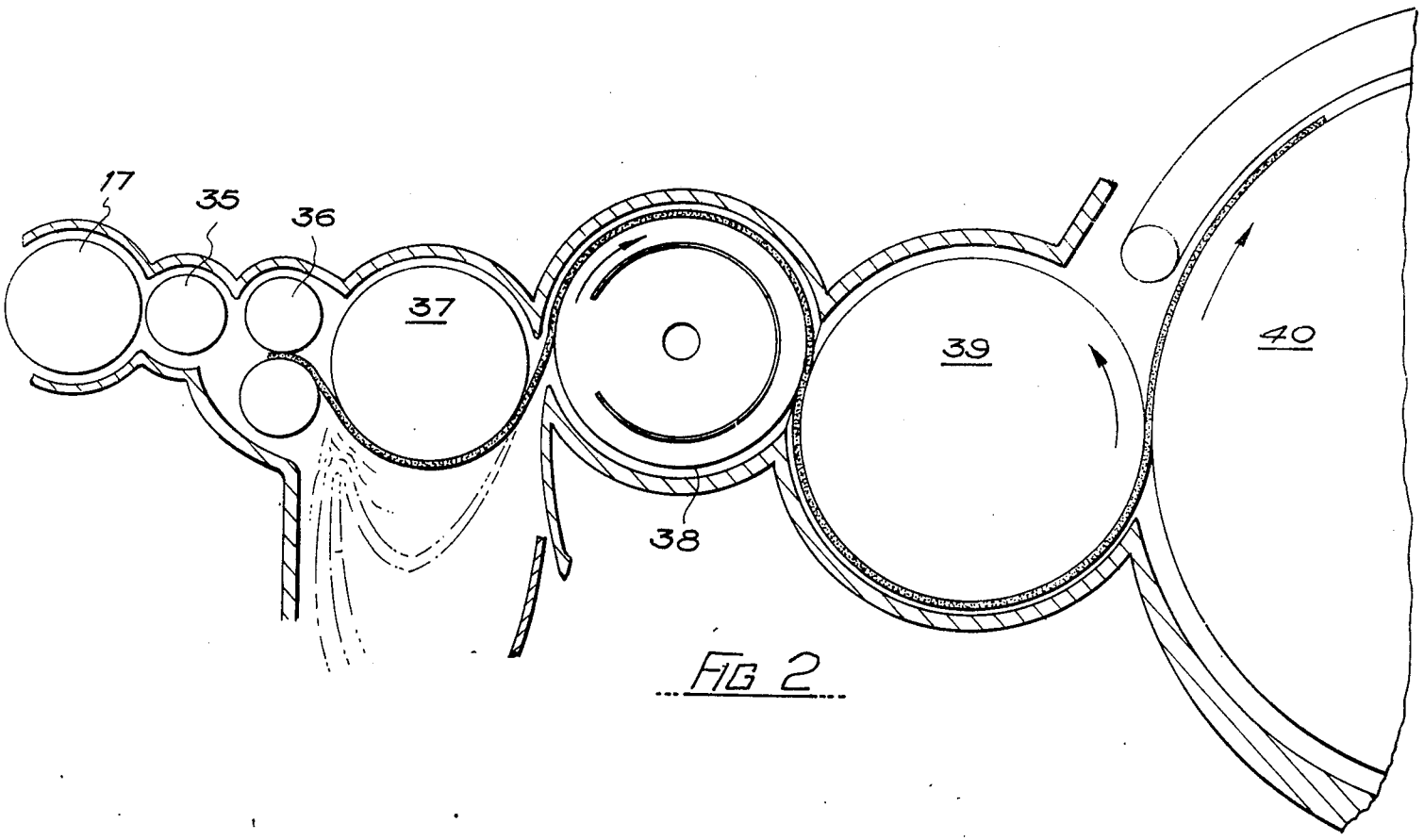

FIG. 2 shows an alternative centre section wherein the web is taken from the breaker doffer 17 by a stripper roller 35 and is then passed to a pair of crush rolls 36, from which the web is taken by a toothed roller 37 rotating at a surface speed sufficiently higher than that of the crush rolls for the web to be broken down into individual fibres or fibre groups. The larger fibres are then collected on the surface of a perforated, partially shrouded vacuum cage 38, similar to that shown in FIG. 1. From the cage 38 the web passes to a takerin 39 for the finisher cylinder 40. The crush rolls are arranged to exert a heavy pressure on the web so that any impuritites remaining after the first carding action tend to be crushed and broken down. This makes it easier for the high speed roller 37 to throw trash and dirt from the web prior to the reassembly of the web on the surface of the cage, and the cleaning of dust from the web by the vacuum action within the cage.

Figure 3:
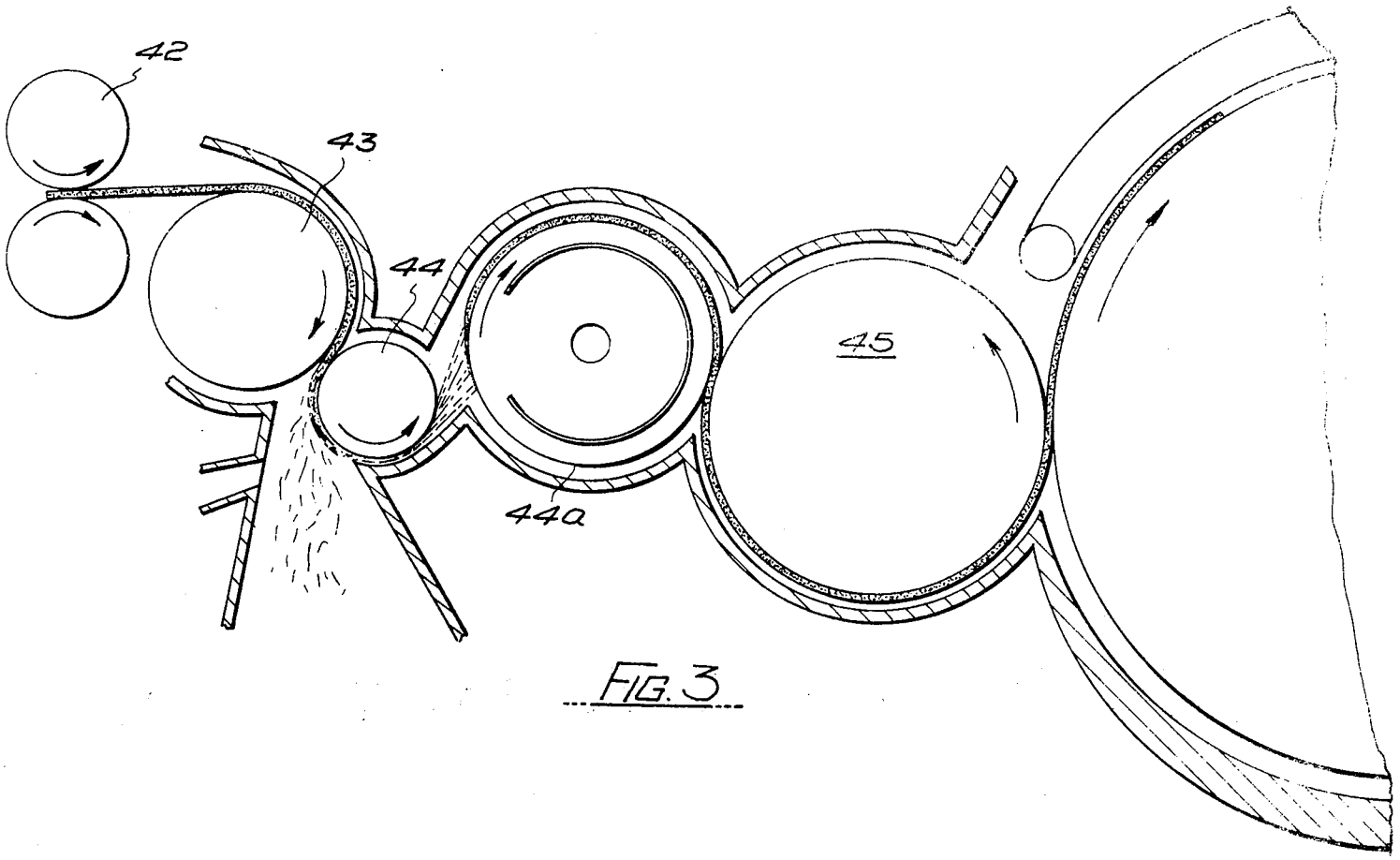

FIG. 3 shows a modification of the centre section shown in FIG. 2, with an additional toothed roller between the crush rolls and the high speed roller. Thus, in this case, from the doffer 17 the web passes to a stripper roller (not shown), crush rolls 42, a first toothed roller 43 and a second toothed roller 44. The second toothed roller rotates at a surface speed sufficiently higher than that of roller 43 to break the web down into individual fibres or fibre groups and release trash and dirt. The larger, usable fibres are then reassembled on the surface of partly shrouded vacuum cage 44*a* and fed by a takerin 45 to the finisher cylinder.

Figure 4:
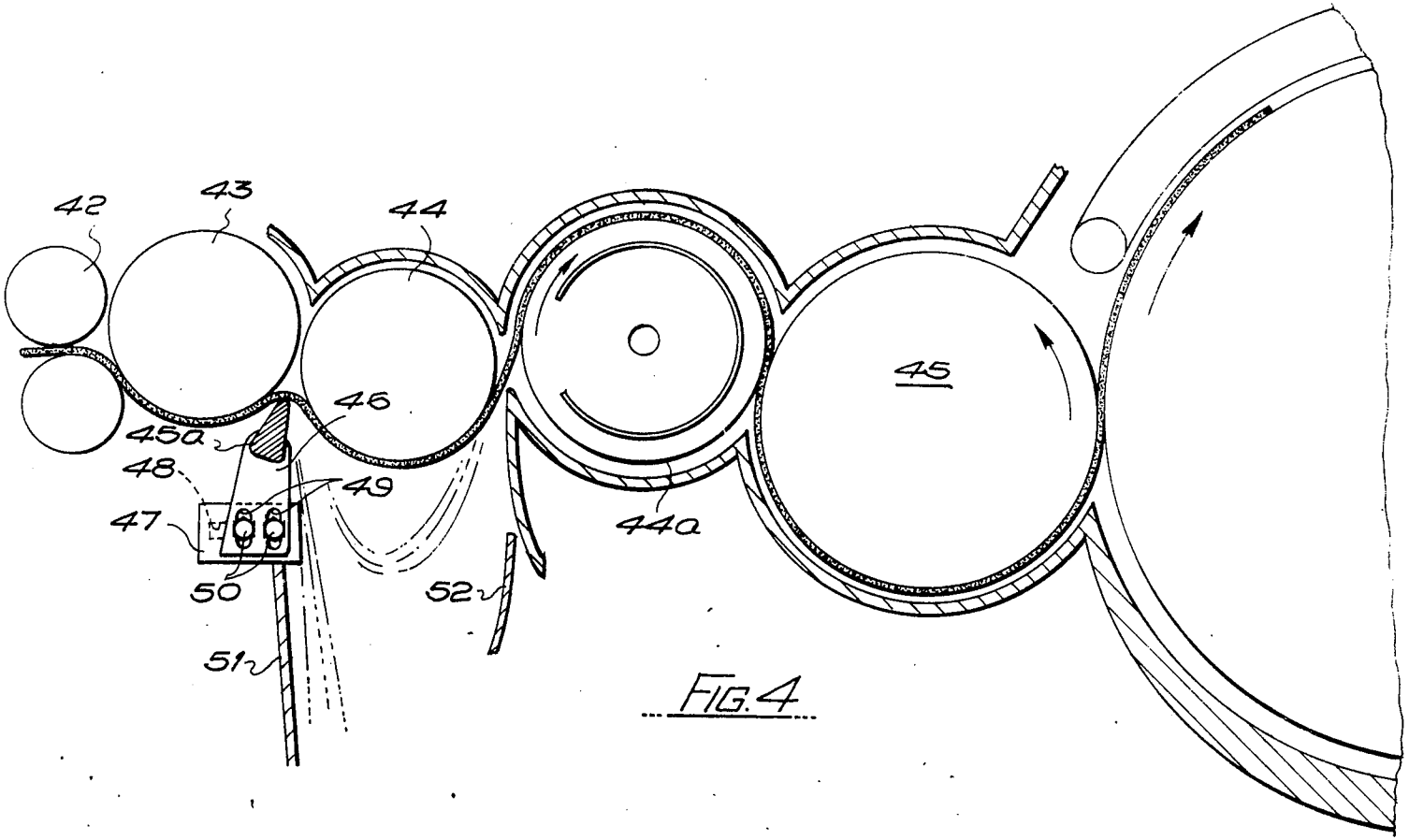

FIG. 4 shows a similar arrangement to that of FIG. 3 and identical parts are given the same references. In this case, however, set between the toothed roller 43 and the toothed roller 44 is a guide member 45*a* over which the web passes to follow a very short curved path between the two rollers and to undergo a sharp change in direction during travel over that path. The guide member 45*a* may take a variety of forms and may be mounted in a fixed or an adjustable manner.

FIG. 4 shows a particular form of guide member comprising a rounded nose part which is integral with a tail mounting member 46. The part 46 is secured to mounting brackets 47 each of which has a horizontal slot 48, while part 46 has a pair of vertical slots 49. Securing screws or bolts 50 are passed through the slots and into support members which may be secured to the frame of the carding engine and/or to a baffle plate 51 positioned below the guide member 45*a*. This arrangement allows the guide member 45*a* to be adjusted vertically, horizontally and pivotally in relation to the rollers 43 and 44 so that there can be accurate setting of the member in relation to the surfaces of these rollers. Clearly, alternative mounting arrangements may be used.

The shape and sectional size of the guide member may be varied as required to suit functional and constructional conditions. Its surface can be a plain smooth formation and desirably the part of the guide member with which the web comes into contact should be rounded rather than sharp. This rounded surface, although preferably smooth, may be patterned by providing fluting, grooving or some other pattern in its surface.

In use the setting of the guide member will act as an anvil against which the breaking up action on the web of the roller 44 occurs, and the guide member may be set to suit the staple length of the fibres being processed.

Baffle plates 51 and 52 define a chute through which trash and very short fibres removed from the web due to the breaking up thereof may fall. The spacing between the guide member 45*a* and the baffle 51 may be adjustable so that the air inlet space formed between these members can be controlled. The air stream passing between the guide member 45*a* and baffle 51 and caused by rotation of the rollers will serve to recover and carry any long fibres which may be thrown out during transfer between rollers 43 and 44. This air stream, however, should not be so strong as to prevent the falling of trash into the chute defined between baffles 51 and 52

By rotating the roller 44 at a surface speed sufficiently faster than that of the roller 43 the individual fibres of the web are forcibly pulled off the surface of roller 43 so that the web is subjected to a breaking up action and the structure of the web is loosened. This, together with the sharp change in direction over guide member 45*a* serves to dismember the web substantially into individual fibres and causes trash and very short fibres to be set free to fall into the chute between baffles 51 and 52.

The amount of cleaning action achieved at the rollers 43 and 44 will be affected by the speeds of the rollers, the setting of the guide member 45*a* and the type of wire covering used on the rollers. The final choice of settings and speeds are chosen to obtain maximum cleaning consistent with an acceptable level of fibre loss. It will generally be found that for best results the roller 44 should have a surface speed of from 2 to 6 times that of roller 43, with the particularly preferred range being from 2.5 to 4 times. These preferred ratios apply equally to the other embodiments shown, i.e. of roller 18 to doffer 17 in FIG. 1, of roller 37 to crush rolls 36 in FIG. 2 and of roller 44 to roller 43 in FIG. 3.

Figure 5:
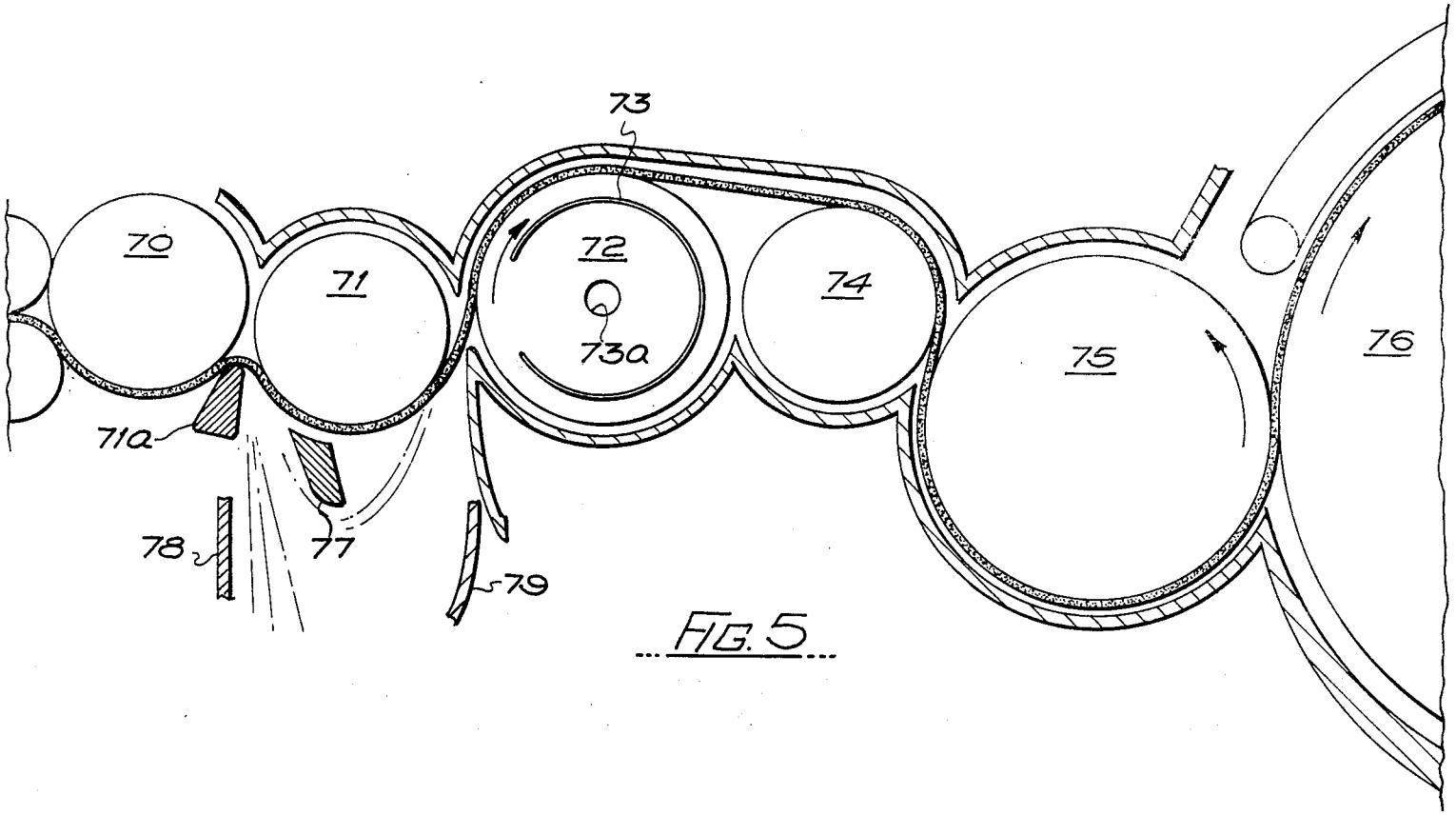

FIG. 5 shows another embodiment, and in this centre section arrangement the web is taken from the breaker doffer by a stripper roller and passed to crush rolls 42, thence to a transfer roller 70 and then to a further roller 71 rotating at a surface speed sufficiently greater than that of roller 70 to break up the web. Positioned between rollers 70 and 71 is a guide member 71*a*, which may be similar to that described with reference to FIGS. 1 and 2. Longer, usable fibres carried by or thrown from the surface of roller 71 are collected on the surface of a vacuum cage 72 rotating at a peripheral speed less than roller 71, and sufficiently low to collect enough fibres per unit area to form a web. The cage 72 has a perforated surface which is partially shrouded by a shroud 73, and air is sucked from the cage through an axial pipe 73*a*. From this cage the web is carried by a transfer roller 74 to a takerin 75 for the cylinder 76 of the finisher card. A streamer plate 77 is positioned below the high speed roller 71 so that an air flow induced into the apparatus carried with it good fibre and some dust below the streamer plate and up into the space between the adjacent arc of the roller 71 and cage 72. Trash and short fibres fall from this air stream into a trash chute defined between plates 78 and 79. The vacuum in cage 72 not only causes the fibres thrown from roller 71 to be collected on the surface of the cage, but it also sucks residual dust into the interior of the cage and thence through the pipe 73*a* to a waste outlet, so leaving the fibre even cleaner.

To demonstrate the surprising advantage gained using the invention, a duo-card as described with reference to FIG. 5 has been run in comparison with a conventional duo-card wherein the web was taken by conventional transfer rolls from the crush rollers 42 to the takerin for the finisher carding cylinder. In the arrangement according to the invention the rollers shown in FIG. 5 have the following diameters and surface speeds:

| | | Diameter (cm) | Surface Speed (cm/min) |
|---|---|---|---|
| Roller | 70 | 14.10 | 15948 |
| Roller | 71 | 23.34 | 46201 |
| Cage | 72 | 26.35 | 3312 |
| Roller | 74 | 16.64 | 4967 |
| Takerin | 75 | 25.08 | 23640 |

It will be noted that the ratio of the speed of roller 71 to that of roller 70 is 2.9, so that the web is substantially broken up into individual fibres. It will also be noted that the surface speed of the cage 72 is very much slower than that of the roller 71, so that the fibres are reassembled into a web on the cage surface. Air was exhausted from the cage at 19.8 $m^3$/min.

The two duo-cards were both run processing cotton, with similar takerin, cylinder, doffer and flats speeds at a production rate of 27.22 kg/hr., the web doffed from the finisher cylinder being condensed in each case to a sliver of 3.56 g/m. The slivers were each direct spun on the rotors of an Investa BD200 open-end spinning machine and the amount of residue in the rotors was measured. On the conventional duo-card the amount of residue was an average of 286.4 mg/kilo of yarn spun; on the duo-card constructed in accordance with FIG. 5 the amount of residue was 105.5 mg/kilo of yarn spun, a very dramatic reduction which indicates the greatly improved cleaning action of a duo-card according to this embodiment of the invention. Visual inspection of the yarn spun from the two slivers showed that the yarn from the duo-card of the invention was both cleaner and more regular than that from the conventional duo-card.

It will be obvious that the roller speeds and other variables given in this example can all be adjusted to give optimum cleaning for any particular fibre type being processed. Furthermore, the size and shape of the perforations in the cage surface may be chosen to obtain the maximum amount of cleaning which is consistent with an acceptable level of fibre loss. The settings of the guide member 71*a* and of the streamer plate 77 may also be adjusted as required.

The feed arrangement to the breaker card cylinder and the feed arrangement from the finisher card cylinder may be modified as desired. A stripper knife may be positioned to cooperate with the finisher takerin to prevent carry over of fibres on the surface of the takerin.

All the arrangements described have the advantage of producing a finished carded web with a high standard of cleanliness. Such arrangements are to be deemed solely as illustrative of the present invention and not limited to the specific embodiments shown, except as set forth in the claims which follow.

I claim:

1. A duo-card engine comprising a breaker card having a breaker carding cylinder, means for feeding staple fibres to the breaker cylinder, a breaker doffer for doffing a web of fibres from the breaker cylinder, a pair of crush rolls downstream of the breaker doffer, a toothed roller downstream of the pair of crush rolls, rotating at a surface speed sufficient to break up the web substantially into individual fibres and fibre groups and free dirt from the same, a partly shrouded, rotatable, perforated vacuum cage adjacent to and downstream of the toothed roller, on the surface of which the fibres are reassembled, means for feeding the fibres from the cage to the cylinder of a finisher card, and a finisher doffer for doffing the web from the finisher cylinder.

2. A duo-card carding engine according to claim 1, in which an intermediate roller is located downstream of said crush rolls and immediately preceding said toothed roller, said intermediate roller being also toothed.

3. A duo-card carding engine according to claim 2, in which the web path is around the lower arcs of the two toothed rollers, in combination with a guide member mounted in the web path between the lower converging arcs of these rollers and extends the full width of these rollers.

4. A duo-card carding engine according to claim 3, in which the guide member is set in the space between the lower converging arcs of the two toothed rollers so that it extends parallel with the axes of both said rollers and is spaced closely adjacent to the peripheral surfaces of each roller.

5. A duo-card carding engine according to claim 3, in which the guide member has a smooth, plain rounded surface over which the web may travel.

6. A duo-card carding engine according to claim 3 in combination with means for adjusting the guide member relative to the two toothed rollers.

7. A duo-card carding engine according to claim 1, in which the means for feeding the fibres from the cage to the cylinder of the finisher card comprise a transfer roller adjacent to and downstream of the vacuum cage for stripping the reassembled web from the vacuum cage, and a finisher takerin adjacent to and downstream of the transfer roller for stripping the reassembled web from the transfer roller and feeding it to the finisher cylinder.

* * * * *